US010828893B2

(12) United States Patent
Morisue et al.

(10) Patent No.: US 10,828,893 B2
(45) Date of Patent: Nov. 10, 2020

(54) LIQUID EJECTING HEAD

(71) Applicant: CANON KABUSHIKI KAISHA, Tokyo (JP)

(72) Inventors: Masafumi Morisue, Tokyo (JP); Yoshiyuki Nakagawa, Kawasaki (JP); Kazuhiro Yamada, Yokohama (JP); Takuro Yamazaki, Inagi (JP); Ryo Kasai, Tokyo (JP); Tomoko Kudo, Kawasaki (JP); Takashi Sugawara, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/439,002

(22) Filed: Jun. 12, 2019

(65) Prior Publication Data

US 2020/0009864 A1 Jan. 9, 2020

(30) Foreign Application Priority Data

Jul. 6, 2018 (JP) ..... 2018-129083

(51) Int. Cl.
*B41J 2/14* (2006.01)

(52) U.S. Cl.
CPC ..... *B41J 2/14145* (2013.01)

(58) Field of Classification Search
CPC ..... B41J 2/14145; B41J 2/14201; B41J 2/18; B41J 2/19; B41J 2/14129; B41J 2/165; B41J 2/04541; B41J 2/16526; B41J 2/17596; B41J 2/14056
See application file for complete search history.

(56) References Cited

U.S. PATENT DOCUMENTS 8,939,531 B2 * 1/2015 Govyadinov et al. ..... B41J 2/04541
10,300,707 B2 5/2019 Nakakubo et al.
2001/0038396 A1 11/2001 Imanaka et al.
2010/0123759 A1 5/2010 Matsui et al.
2010/0220154 A1 * 9/2010 Shibata et al. ..... 347/65
2013/0155135 A1 6/2013 Govyadinov et al.
(Continued)

FOREIGN PATENT DOCUMENTS

EP 0 863 006 A1 9/1998
EP 1 627 743 A1 2/2006
(Continued)

OTHER PUBLICATIONS

Extended European Search Report dated Dec. 12, 2019, in European Patent Application No. 19180461.6.

*Primary Examiner* — Juanita D Jackson
(74) *Attorney, Agent, or Firm* — Venable LLP

(57) ABSTRACT

A liquid ejecting head includes an element substrate including a common liquid chamber connected to a liquid supply source, a pressure chamber connected to the common liquid chamber and including inside an element to generate energy used for ejecting liquid, a bubble generating chamber connected to the common liquid chamber and including inside a pump to cause a flow of the liquid, and a connection flow path connecting the pressure chamber and the bubble generating chamber. The liquid ejecting head includes a first anti-cavitation film over the element to generate the energy and a second anti-cavitation film over the pump, and the first anti-cavitation film and the second anti-cavitation film have different film thicknesses.

20 Claims, 8 Drawing Sheets

(56) References Cited

U.S. PATENT DOCUMENTS

| | | | | |
|---|---|---|---|---|
| 2014/0184702 | A1* | 7/2014 | Ishida et al. | B41J 2/14088 |
| 2014/0368581 | A1 | 12/2014 | Takahashi et al. | |
| 2016/0297194 | A1 | 10/2016 | Sakurai et al. | |
| 2017/0190176 | A1 | 7/2017 | Kudo et al. | |
| 2018/0133746 | A1 | 5/2018 | Govyadinov et al. | |
| 2019/0001672 | A1 | 1/2019 | Hammura et al. | |
| 2019/0001692 | A1 | 1/2019 | Yamazaki et al. | |
| 2019/0023016 | A1 | 1/2019 | Nakagawa et al. | |
| 2019/0023018 | A1 | 1/2019 | Nakagawa et al. | |
| 2019/0092012 | A1 | 3/2019 | Morisue et al. | |

FOREIGN PATENT DOCUMENTS

| | | | |
|---|---|---|---|
| WO | 2011/146149 | A1 | 11/2011 |
| WO | 2012/008978 | A1 | 1/2012 |
| WO | 2012/054412 | A1 | 4/2012 |

* cited by examiner

LIQUID EJECTING HEAD

BACKGROUND OF THE DISCLOSURE

Field of the Disclosure

The present disclosure relates to liquid ejecting heads.

Description of the Related Art

In a liquid ejecting head used for a liquid ejection apparatus that ejects liquid, such as ink, the evaporation of volatile components in the liquid may thicken the liquid in the ejecting ports. In the case where the increase in the viscosity is noticeable, it increases the liquid resistance, and this may prevent proper ejecting. As a measure against such a liquid thickening phenomenon, a method is known in which fresh liquid is made to flow through the ejecting port in the pressure chamber.

As a method of making liquid flow the ejecting port in the pressure chamber, there is known a technique of providing a microrecirculation system in the liquid ejecting head, including an auxiliary micro bubble pump composed of a heating resistor element and mounted on the liquid ejecting head (see International Laid-Open No. WO2012/008978 and International Laid-Open No. WO2012/054412). For a thermal-inkjet liquid ejecting head, when elements for ejecting liquid are formed, micro bubble pumps can be formed at the same time. Thus, the microrecirculation system can be formed efficiently.

Meanwhile, the heating resistor elements may be damaged by water hammering caused when an air bubble generated by heating collapses. To address this, it is conceivable to form a metal film made of, for example, tantalum as an anti-cavitation film. It is common to form an anti-cavitation film for protecting an element to generate energy for ejecting liquid and an anti-cavitation film for protecting a heating resistor element for pumping at the same time, from the viewpoint of improving the productivity. However, the degree of thermal efficiency and the degree of durability of the anti-cavitation film required for each element is different. Thus, if anti-cavitation films are formed without considering characteristics required for the elements, the thermal efficiency and the reliability of the anti-cavitation films may be low in some cases.

SUMMARY OF THE DISCLOSURE

A liquid ejecting head according to an aspect of the present disclosure includes an element substrate including: a common liquid chamber connected to a liquid supply source; a pressure chamber connected to the common liquid chamber and including inside an element to generate energy used for ejecting liquid; a bubble generating chamber connected to the common liquid chamber and including inside a pump to cause a flow of the liquid; and a connection flow path connecting the pressure chamber and the bubble generating chamber. The liquid ejecting head includes a first anti-cavitation film over the element to generate the energy and a second anti-cavitation film over the pump, and the first anti-cavitation film and the second anti-cavitation film have different film thicknesses.

Further features of the present disclosure will become apparent from the following description of exemplary embodiments with reference to the attached drawings.

DESCRIPTION OF THE EMBODIMENTS

Hereinafter, liquid ejecting heads and liquid ejecting apparatuses according to embodiments of the present disclosure will be described with reference to the drawings. Examples of liquid ejecting heads include inkjet print heads that eject ink. Examples of liquid ejecting apparatuses include inkjet printing apparatuses. Note that examples of liquid ejecting heads and liquid ejecting apparatuses are not limited to these ones. Liquid ejecting heads and liquid ejecting apparatuses are applicable to printers, copiers, fax machines having a communication system, and apparatuses having a printer portion, such as word processors, and also applicable to industrial printing apparatuses complexly combined with various processing apparatuses. For example, they can also be used for applications such as making biochips and electronic circuit printing.

The embodiments described below are suitable specific examples, and thus, the embodiments include various technically favorable limitations. However, the present disclosure is not limited to the embodiments and other specific methods described in this specification.

First Embodiment

Figure 1:
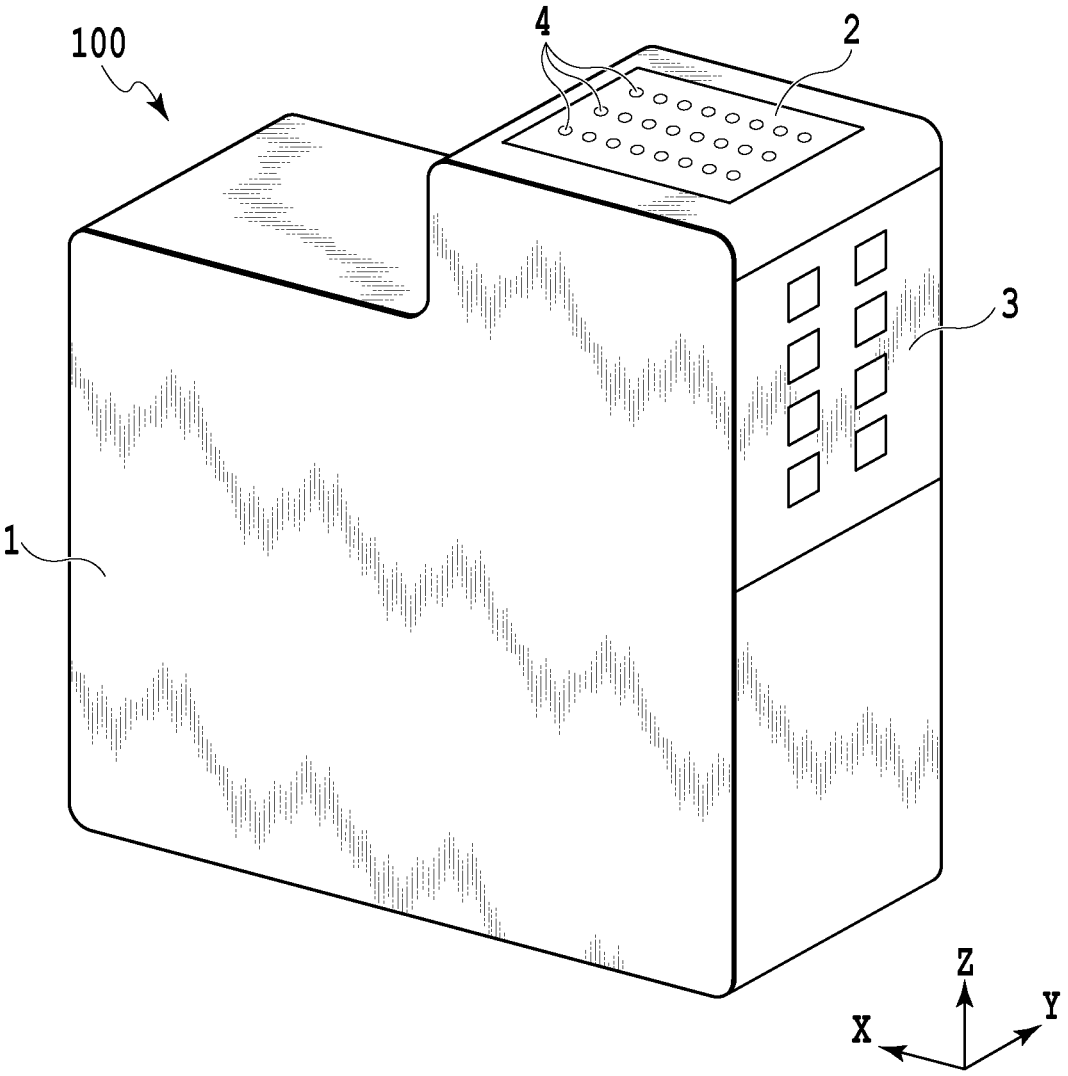
FIG. 1 is a perspective view of an example of a liquid ejecting head.

FIG. 1 is a perspective view of an example of a liquid ejecting head 100 in this embodiment. The liquid ejecting head 100 includes a casing 1, an element substrate 2, and electrical contacts 3. The element substrate 2 has elements (hereinafter, referred to as energy generating elements) that generate energy used to eject liquid. The energy generating element 5 (for example, see FIG. 2) is, for example, a heating resistor element. An ejection port 4 is formed over the energy generating element 5 in the stacking direction (the Z-direction). Hereinafter, the direction of the side on which the ejecting port 4 is formed relative to the position of the energy generating element 5 is defined as the upper side. The energy generating element 5 is supplied with energy by electrical signals supplied to the electrical contacts 3, and the ejecting port 4 corresponding to the energy generating element 5 ejects liquid. The liquid to be ejected is supplied from a not-illustrated liquid supply source (for example, a tank) disposed inside the casing 1. Alternatively, by connecting a not-illustrated liquid supply source disposed outside and the liquid ejecting head 100 through, for example, a tube, the liquid is supplied from the tank to the liquid ejecting head 100.

Figure 2:
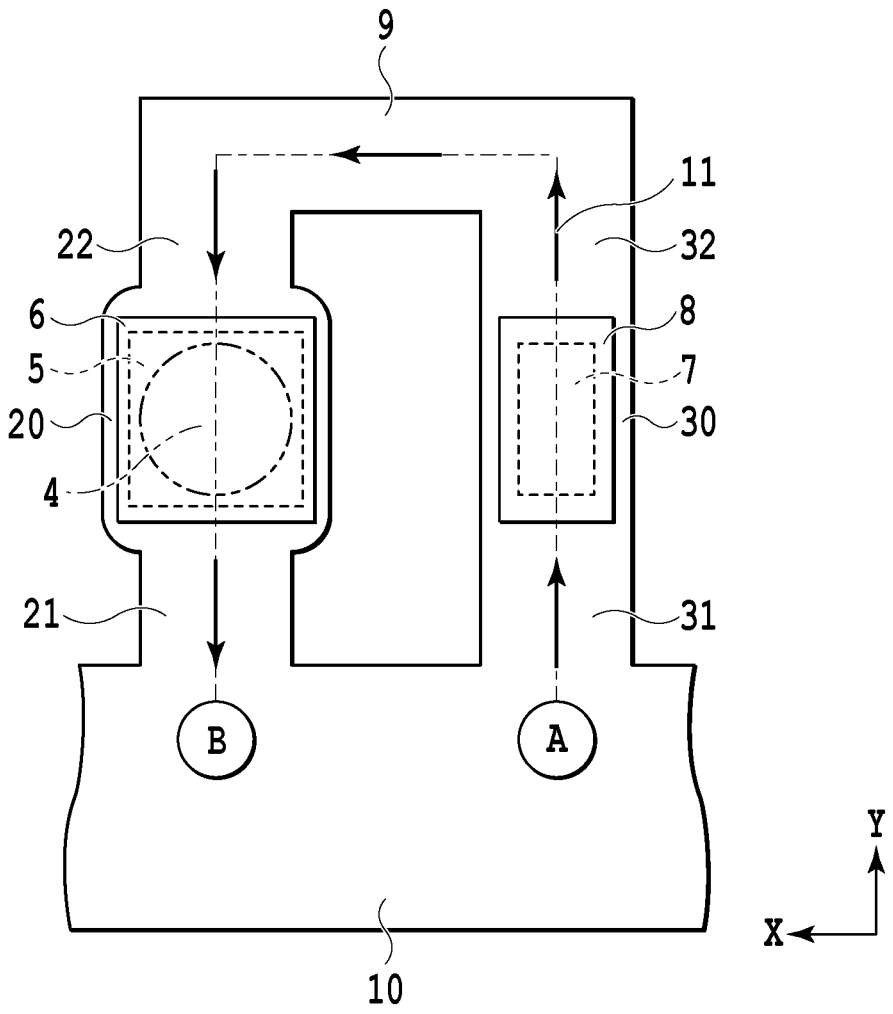
FIG. 2 is a top view of part of an element substrate.

FIG. 2 is a top view of part of the element substrate 2 of this embodiment. The element substrate 2 has a common liquid chamber 10. FIG. 2 illustrates part of the flow path connecting the common liquid chamber 10 and one ejecting port 4. As illustrated in FIG. 2, the element substrate 2 includes the common liquid chamber 10, a pressure chamber 20 for liquid ejection, the energy generating element 5 disposed at the pressure chamber 20, and the ejecting port 4 disposed at a position facing the energy generating element 5 in the stacking direction. A first end portion 21 of the pressure chamber 20 is connected to the common liquid chamber 10 via the flow path. The element substrate 2 also includes a for-pumping bubble generating chamber 30 that has a first end portion 31 connected to the common liquid chamber 10 via a flow path and a for-pumping heat generating element 7 disposed in the for-pumping bubble generating chamber 30. The for-pumping heat generating element 7 (pump) is, for example, a heating resistor element. A second end portion 22 of the pressure chamber 20 and a second end portion 32 of the for-pumping bubble generating chamber 30 are connected to a connection flow path 9.

Based on the flow caused by bubbles generated by the for-pumping heat generating element 7, the liquid circulates from the common liquid chamber 10 through the for-pumping bubble generating chamber 30, connection flow path 9, and pressure chamber 20. In other words, the liquid flows from the common liquid chamber 10 into the for-pumping bubble generating chamber 30, and then the liquid flows through the connection flow path 9 and the pressure chamber 20 and is discharged into the common liquid chamber 10. In summary, the liquid ejecting head 100, including the pressure chambers 20 each including the energy generating element 5 inside, is configured such that the liquid inside the pressure chamber 20 can circulate between the pressure chamber 20 and the outside of it. The direction of the flow of the liquid flowing from the common liquid chamber 10 through the for-pumping bubble generating chamber 30, connection flow path 9, and pressure chamber 20 and discharged into the common liquid chamber 10 is indicated by the arrows 11. The exact position of the for-pumping heat generating element 7 may vary from the position illustrated in FIG. 2. However, no matter where the for-pumping heat generating element 7 is disposed, the for-pumping heat generating element 7 is disposed asymmetrically with respect to the center point (midpoint) of the circulating flow path in the length direction. In other words, the for-pumping heat generating element 7 is disposed at a position other than the center point (midpoint) of the circulating flow path in the length direction. In other words, the for-pumping heat generating element 7 is disposed at an asymmetrical position such that the length of one of the circulating flow paths from the common liquid chamber 10 to the for-pumping heat generating element 7 is longer than the length of the other. Such an asymmetrical position of the for-pumping heat generating element 7 in the circulating flow path is the basis (base) that the liquid flows in one direction. Specifically, in the length direction of the circulating flow path, the liquid flows from the part of the circulating flow path in which the distance between the for-pumping heat generating element 7 and the common liquid chamber 10 is shorter, to the part of the circulating flow path in which the distance between the for-pumping heat generating element 7 and the common liquid chamber 10 is longer. As a result, the liquid flows as indicated by the arrows 11.

Note that although in this embodiment, description is provided using a schematic diagram in which the flow path is connected in the relationship of one for-pumping heat generating element 7 per ejecting port 4, the present disclosure is not limited to this example. For example, the connection flow path 9 may branch off and be connected to multiple ejecting ports 4 and multiple for-pumping heat generating elements 7. Alternatively, one for-pumping heat generating element 7 may be disposed for multiple ejecting ports 4. In addition, although FIG. 2 illustrates a configuration in which the for-pumping bubble generating chamber 30, connection flow path 9, and pressure chamber 20 are disposed on the +Y-direction side of the common liquid chamber 10, the for-pumping bubble generating chamber 30, connection flow path 9, and pressure chamber 20 may be disposed also on the −Y-direction side of the common liquid chamber 10.

The element substrate 2 includes a first anti-cavitation film 6 for protecting the energy generating element 5 as illustrated in FIG. 2. In addition, the element substrate 2 includes a second anti-cavitation film 8 for protecting the for-pumping heat generating element 7. Specifically, over the energy generating element is the first anti-cavitation film, and over the pump is the second anti-cavitation film. For the anti-cavitation films, it is common to use what is appropriately selected from metal films made of tantalum, iridium, or the like. The film thicknesses of the anti-cavitation films should preferably be within the range of 10 nm to 500 nm inclusive.

In this embodiment, the film thickness of the first anti-cavitation film 6 and the film thickness of the second anti-cavitation film 8 should preferably be different. It is because the first anti-cavitation film 6 for the energy generating element 5 and the second anti-cavitation film 8 for the for-pumping heat generating element 7 require different characteristics. For both anti-cavitation films, high thermal efficiency and high reliability of the anti-cavitation film are common requirements. However, the degree required for each element is different. For example, the number of times of bubble generation required for durability is different. In addition, since the for-pumping heat generating element 7 generates bubbles in a closed space unlike the energy generating element 5, the heat generating element 7 receives greater cavitation damage per bubble generating operation than the energy generating element 5.

For a higher anti-cavitation property, the film thickness of the anti-cavitation film should preferably be formed to be larger. On the other hand, for higher bubble-generation energy efficiency (thermal efficiency), the film thickness of the anti-cavitation film should preferably be formed to be smaller. In other words, the thermal efficiency and the reliability of the anti-cavitation film are in a trade-off relationship. Specifically, a smaller film thickness of the anti-cavitation film is preferable for higher thermal efficiency, but in this case, the reliability of the anti-cavitation film is lower. On the other hand, a larger film thickness of the anti-cavitation film is preferable for higher reliability of the anti-cavitation film, but in this case, the thermal efficiency is lower.

In this embodiment, the film thicknesses of the anti-cavitation films are adjusted according to the characteristics required for the energy generating element 5 and the for-pumping heat generating element 7. In other words, the first anti-cavitation film 6 over the energy generating element 5 and the second anti-cavitation film 8 over the for-pumping heat generating element 7 are disposed to have different film thicknesses. This configuration allows the reliability of anti-cavitation and the thermal efficiency to be adjusted for each of the energy generating element 5 (ejecting function) and the for-pumping heat generating element 7 (pumping function), separately. This makes it possible to provide a liquid ejecting head having a microrecirculation system with high efficiency and high reliability.

Figure 3A:
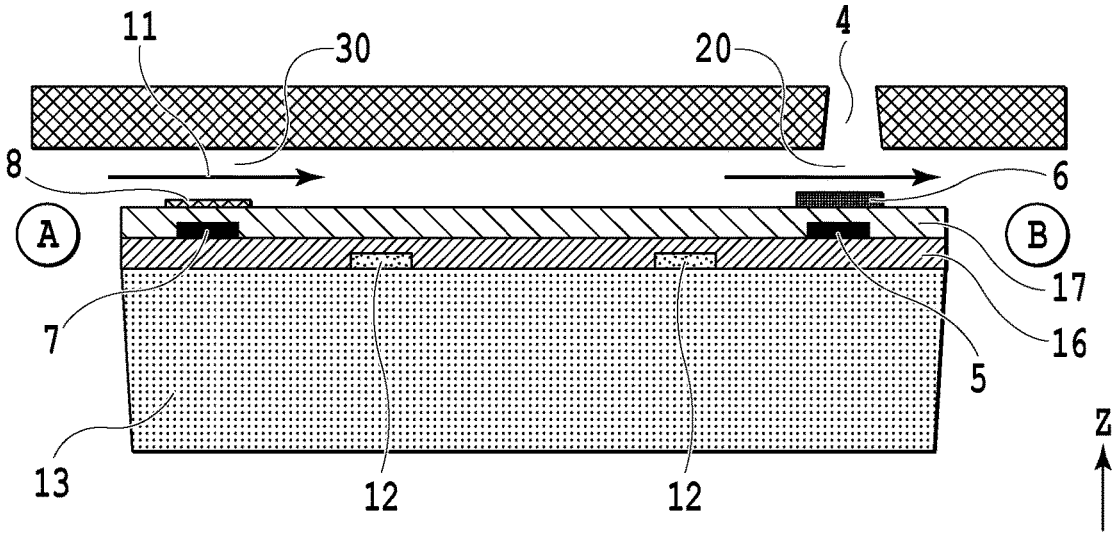
FIGS. 3A and 3B are cross-sectional views of element substrates taken along the flow path in the liquid-flow direction.
Figure 3B:
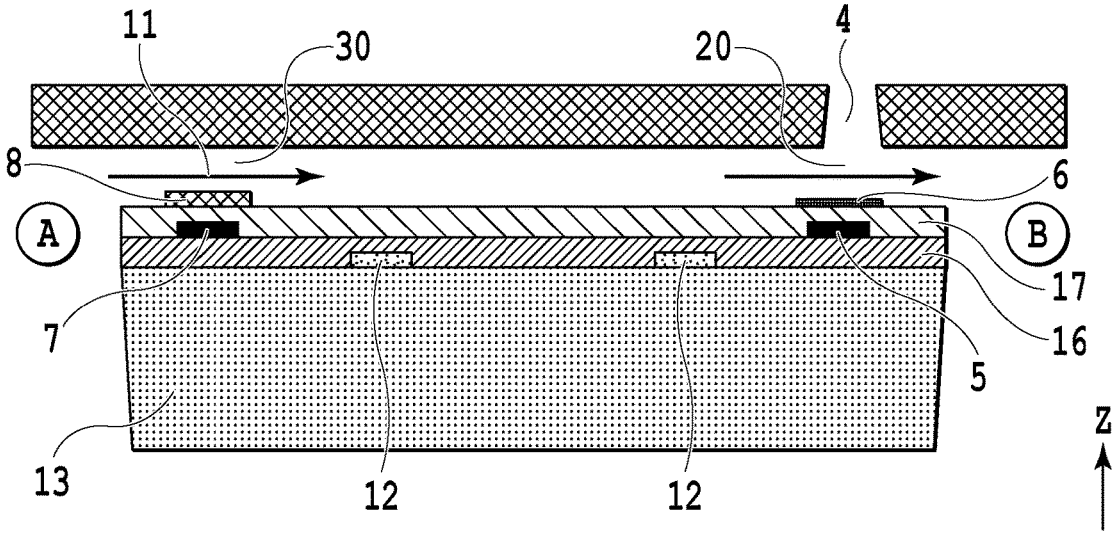

Each of FIGS. 3A and 3B is a cross-sectional view of an element substrate taken along the flow path in the liquid-flow direction from point A to point B (hereinafter, referred to as the circulating flow path), indicated with the dashed dotted lines in FIG. 2. On (on the ejecting port side of) a substrate 13 are disposed an insulating film layer 16 and a thin film layer 17. In the insulating film layer 16 are formed electronic elements 12. In the thin film layer 17 are formed an energy generating element 5 and a for-pumping heat generating element 7. Over the energy generating element 5 is formed a first anti-cavitation film 6. Over the for-pumping heat generating element 7 is formed a second anti-cavitation film 8.

FIG. 3A illustrates a case where the film thickness of the first anti-cavitation film 6 over the energy generating element 5 is larger than the film thickness of the second anti-cavitation film 8 over the for-pumping heat generating element 7. This is based on the assumption that, for example, the thermal efficiency of the for-pumping heat generating element 7 is high, and that thus, the number of times of bubble generation for pumping can be smaller than the number of times of bubble generation for ejecting liquid. In this case, the anti-cavitation property required for the second anti-cavitation film 8 over the for-pumping heat generating element 7 is also reduced accordingly. Thus, the film thickness of the second anti-cavitation film 8 can be smaller than the film thickness of the first anti-cavitation film 6. In this example, the second anti-cavitation film 8 can achieve both high thermal efficiency and keeping of the reliability. At the same time, the first anti-cavitation film 6 can keep the durability (reliability) necessary for liquid ejection. Specifically, the film thickness of the first anti-cavitation film 6 is set within the range of 100 nm to 400 nm inclusive, and the film thickness of the second anti-cavitation film 8 is set within the range of 10 nm to 100 nm inclusive. Note that the ranges of the film thickness include the same value (100 nm), and that the film thickness of the first anti-cavitation film 6 needs to be larger than the film thickness of the second anti-cavitation film 8. For example, in the case where the film thickness of the first anti-cavitation film 6 is 100 nm, the film thickness of the second anti-cavitation film 8 needs to be 10 nm or more and less than 100 nm.

FIG. 3B illustrates a case where the film thickness of the first anti-cavitation film 6 is smaller than the film thickness of the second anti-cavitation film 8. This is based on the assumption that, for example, the number of times of bubble generation of the pump for causing the circulating flow needs to be larger than the number of times of bubble generation for ejecting liquid. In this case, since the number of times of bubble generation for ejecting liquid can be relatively small, the film thickness of the first anti-cavitation film 6 is made small to optimize the anti-cavitation performance for liquid ejection, which improves the thermal efficiency for liquid ejection. This is useful in that the thermal efficiency for liquid ejection can be improved while keeping the durability necessary for the for-pumping heat generating element 7. Specifically, the film thickness of the first anti-cavitation film 6 is set within the range of 100 nm to 400 nm inclusive, and the film thickness of the second anti-cavitation film 8 is set within the range of 200 nm to 500 nm inclusive. Note that the ranges of the film thickness include the same values (100 nm or more and 400 nm or less), and that the film thickness of the first anti-cavitation film 6 needs to be smaller than the film thickness of the second anti-cavitation film 8. For example, in the case where the film thickness of the second anti-cavitation film 8 is 200 nm, the film thickness of the first anti-cavitation film 6 needs to be 100 nm or more and less than 200 nm.

<Modification>

Note that description has been provided in the above example for the case where the film thicknesses of the first anti-cavitation film 6 and the second anti-cavitation film 8 are made different, but the present disclosure is not limited to this setting. For example, the first anti-cavitation film 6 and the second anti-cavitation film 8 may be different kinds of films. The anti-cavitation film may be composed of layers of multiple materials. For the case where a higher anti-cavitation property is required, a platinum group material, such as iridium, is used. For example, by simultaneously depositing two layers, a tantalum layer and an iridium layer, from the bottom and selectively removing part of the layers using etching masks, it is possible to obtain an anti-cavitation film of a single tantalum layer and an anti-cavitation film of a layered structure made of iridium and tantalum. In this case, the single tantalum layer can be used as an example of a smaller film thickness, and the layered structure made of iridium and tantalum may be used as an example of a larger film thickness. Compared to changing the film thickness using one kind of material, combining different kinds of metals makes it possible to control the film thickness with relatively high accuracy, with appropriate adjustment of the selectivity of etchant and the like.

As described above, in this embodiment, the first anti-cavitation film 6 over the energy generating element 5 and the second anti-cavitation film 8 over the for-pumping heat generating element 7 are formed to have different film thicknesses. Alternatively, in this embodiment, the first anti-cavitation film 6 over the energy generating element 5 and the second anti-cavitation film 8 over the for-pumping heat generating element 7 are different kinds of films. These configurations allow the anti-cavitation reliability and the thermal efficiency to be adjusted for each of the ejecting function and the pumping function separately. This makes it possible to provide a liquid ejecting head having a micro-recirculation system with high efficiency and high reliability.

Second Embodiment

In this embodiment, description will be provided for a configuration that includes a first anti-cavitation film 6 for protecting the energy generating element 5 but does not include an anti-cavitation film for protecting the for-pumping heat generating element 7. In other words, in this configuration, the film thickness of the first anti-cavitation film 6 is a specified film thickness (for example, the film thickness within the range of 10 nm to 500 nm), and the film thickness of the second anti-cavitation film 8 described in the first embodiment is 0 nm (in other words, an anti-cavitation film is not formed).

Figure 4A:
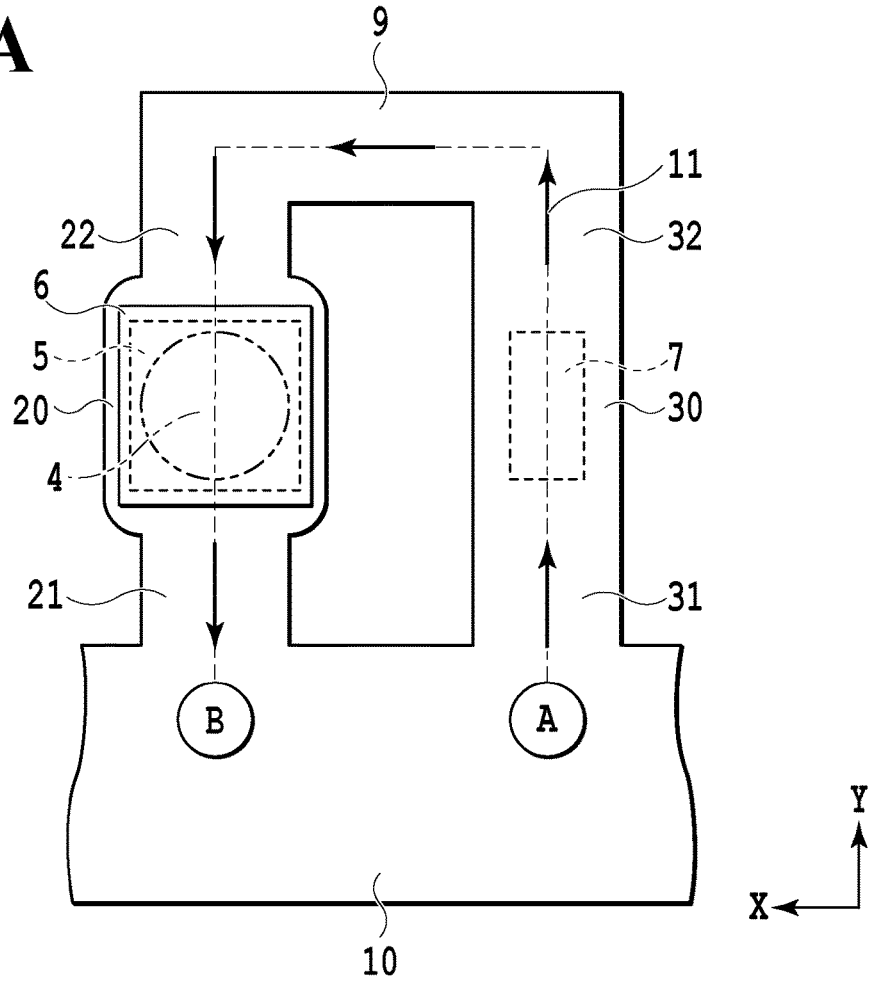
FIGS. 4A and 4B are a top view and cross-sectional view of part of an element substrate.
Figure 4B:
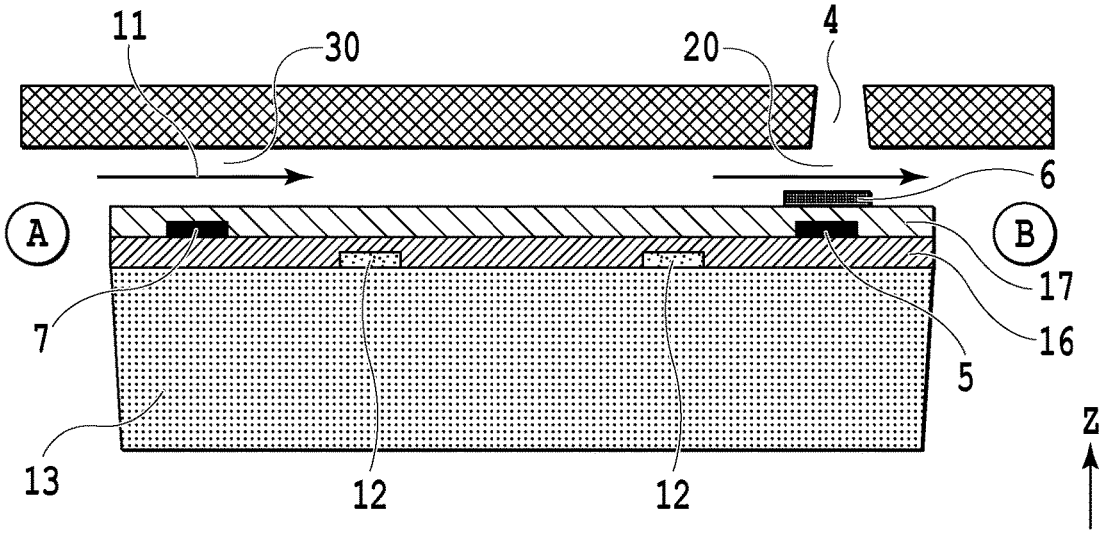

FIGS. 4A and 4B are diagrams illustrating part of an element substrate 2 of this embodiment. FIG. 4A is a top view of part of the element substrate 2. FIG. 4B is a cross-sectional view of the element substrate taken along the circulating flow path from point A to point B, indicated with the dashed dotted lines in FIG. 4A. As illustrated in FIGS. 4A and 4B, there is no anti-cavitation film over the for-pumping heat generating element 7.

The reason why no anti-cavitation film is disposed over the for-pumping heat generating element 7 in this embodiment is as follows. For example, it is conceivable that a bubble generated by the for-pumping heat generating element 7 moves downstream of the for-pumping heat generating element 7 in the circulating direction along the liquid flow indicated with the arrows 11 by the time the bubble collapses, and that the bubble then collapses at a position on the substrate surface, other than the for-pumping heat generating element 7. For such a case, there is no need to protect the for-pumping heat generating element 7. Thus, here, the second anti-cavitation film 8 described in the first embodiment is not necessary. In the case where there is no anti-cavitation film for the for-pumping heat generating element 7, the thermal efficiency of the for-pumping heat generating element 7 is improved. At the same time, the reliability of the energy generating element 5 for liquid ejection can be kept because there is an anti-cavitation film for it. Thus, it is possible to provide a liquid ejecting head having a micro-recirculation system with improved thermal efficiency and improved reliability of the anti-cavitation film.

Third Embodiment

The configuration in this embodiment includes a first anti-cavitation film 6 for protecting the energy generating element 5 and a second anti-cavitation film 8 for protecting the for-pumping heat generating element 7, as in the first embodiment. In this embodiment, the second anti-cavitation film 8 extends into the connection flow path 9.

Figure 5A:
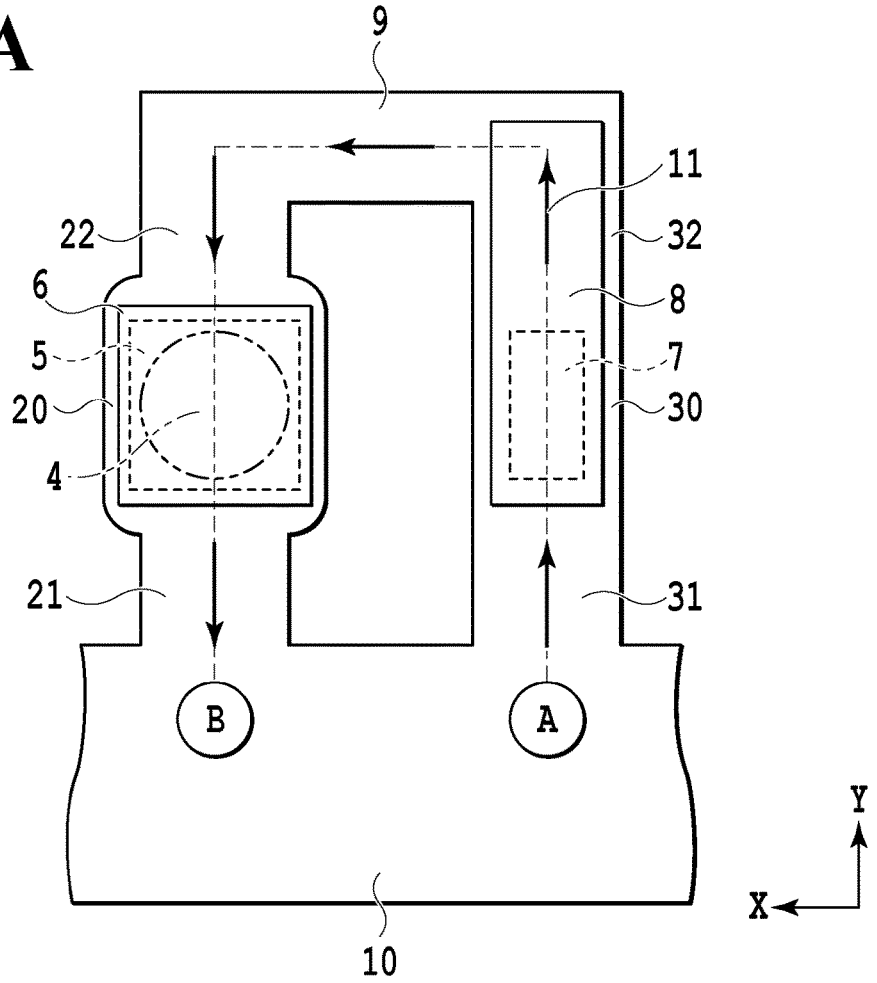
FIGS. 5A and 5B are a top view and cross-sectional view of part of an element substrate.
Figure 5B:
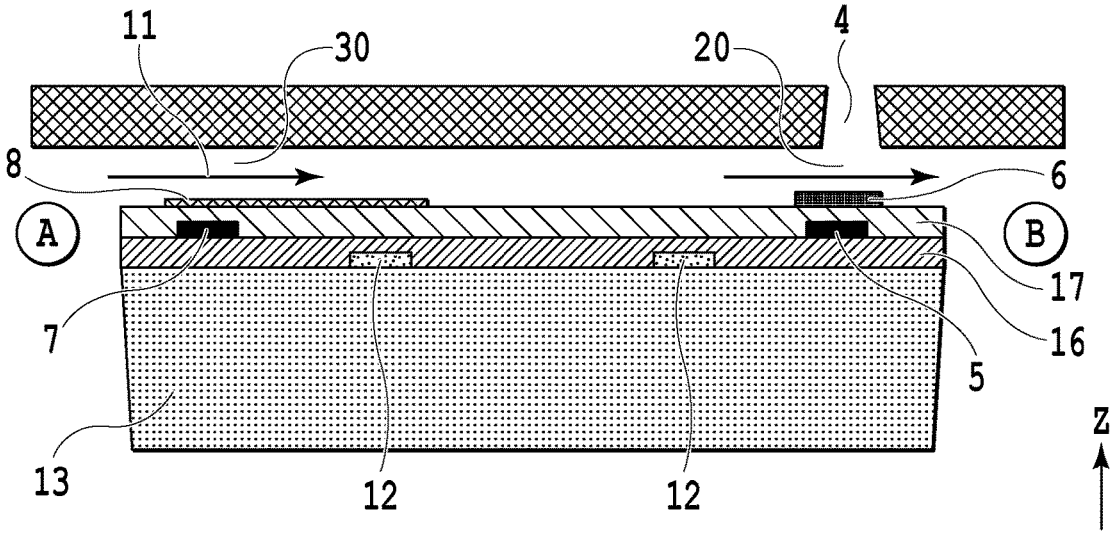

FIGS. 5A and 5B are diagrams illustrating part of an element substrate 2 of this embodiment. FIG. 5A is a top view of part of the element substrate 2. FIG. 5B is a cross-sectional view of the element substrate taken along the circulating flow path from point A to point B, indicated with the dashed dotted lines in FIG. 5A.

The reason why the second anti-cavitation film 8 extends into the connection flow path 9 in this embodiment is as follows. As described in the second embodiment, there is a case where a bubble generated by the for-pumping heat generating element 7 moves downstream of the for-pumping heat generating element 7 in the circulating direction along the liquid flow indicated with the arrows 11 by the time the bubble collapses, and that the bubble then collapses at a position on the substrate surface, other than the for-pumping heat generating element 7. In some cases, there are electronic elements 12 on the substrate in addition to the energy generating element 5 and the for-pumping heat generating element 7. Examples of electronic elements 12 include transistors for controlling the bubble generation timing and electric wiring. If a bubble generated by the for-pumping heat generating element 7 collapses in the area of an electronic element 12, it may damage the electronic element 12. The position of bubble collapsing occurrence is not stable, but the position may be affected by the driving condition, the environment, and other factors and vary randomly.

In this embodiment, the second anti-cavitation film 8 extends at least up to the position of the connection flow path 9 located downstream of the for-pumping heat generating element 7 in the circulating direction, where bubble collapsing may occur, so that the second anti-cavitation film 8 can protect the for-pumping heat generating element 7 and the electronic element 12. In other words, the second anti-cavitation film 8 covers the electronic element. This configuration further improves the reliability of the anti-cavitation film. In addition, since the second anti-cavitation film 8 extends as a continuous film from the position where a bubble is generated by the for-pumping heat generating element 7, there is no step or no change in wettability, and this configuration prevents phenomena that impede the flow, such as a bubble being caught at a certain position.

Also, in this embodiment, the film thickness of the first anti-cavitation film 6 and the film thickness of the second anti-cavitation film 8 may be different, as described in the first embodiment. FIGS. 5A and 5B illustrate a configuration example in which the film thickness of the second anti-cavitation film 8 is smaller than the film thickness of the first anti-cavitation film 6. As described in the modification of the first embodiment, the first anti-cavitation film 6 and the second anti-cavitation film 8 may be different kinds of films.

Note that in the configuration illustrated in FIGS. 5A and 5B, an electronic element 12 is disposed also upstream of the energy generating element 5 in the circulating direction. In the case where the position of bubble collapsing occurrence reaches the position of the electronic element 12 upstream of the energy generating element 5 in the circulating direction, the second anti-cavitation film 8 may further be extended.

Fourth Embodiment

The configuration in this embodiment includes the second anti-cavitation film 8 for protecting the for-pumping heat generating element 7, as in the first embodiment. The configuration in this embodiment includes a third anti-cavitation film in addition to the first anti-cavitation film 6 and the second anti-cavitation film 8.

Figure 6A:
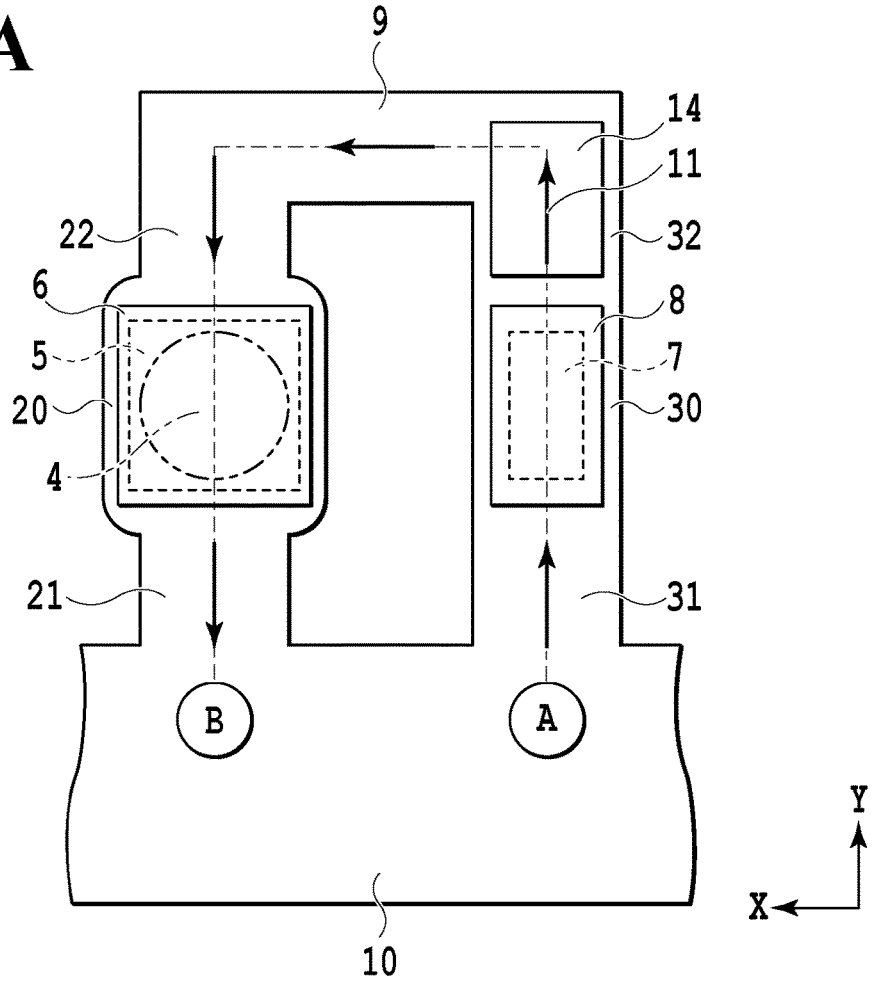
FIGS. 6A and 6B are a top view and cross-sectional view of part of an element substrate.
Figure 6B:
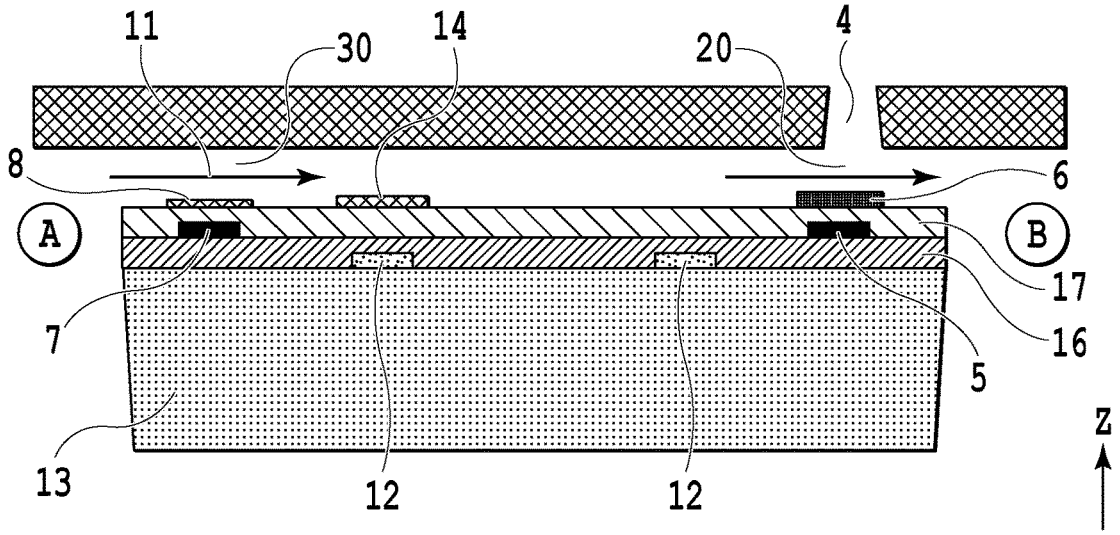

FIGS. 6A and 6B are diagrams illustrating part of an element substrate 2 of this embodiment. FIG. 6A is a top view of part of the element substrate 2. FIG. 6B is a cross-sectional view of the element substrate taken along the circulating flow path from point A to point B, indicated with the dashed dotted lines in FIG. 6A. The third anti-cavitation film 14 is disposed to protect the electronic element 12 located downstream of the for-pumping heat generating element 7 in the circulating direction. Although the configuration illustrated in FIGS. 6A and 6B has one third anti-cavitation film 14, the present disclosure is not limited to this configuration. A necessary number of third anti-cavitation films 14 may be formed at locations where they are necessary.

In this embodiment, the anti-cavitation films each may have a different thickness. As described in the first embodiment, the film thickness of the first anti-cavitation film 6 and the film thickness of the second anti-cavitation film 8 may be different. Further, the film thickness of the third anti-cavitation film 14 is also different from those of the first anti-cavitation film 6 and the second anti-cavitation film 8. In the case where in the variation in the position of the bubble collapsing occurrence, statistics show that bubble collapsing occurs in the area of the electronic element 12 more frequently than in the area of the for-pumping heat generating element 7, the film thickness of the third anti-cavitation film 14 is set larger than the film thickness of the second anti-cavitation film 8. Note that as described in the modification of the first embodiment, each anti-cavitation film may be a different kind of film. These configurations make it possible to improve the bubble generation efficiency of the for-pumping heat generating element 7 while keeping necessary anti-cavitation properties. In addition, since the second anti-cavitation film and the third anti-cavitation film are separate, in the case where film damage (such as electrolytic corrosion) occurs, they would not affect each other.

Note that in the configuration illustrated in FIGS. 6A and 6B, an electronic element 12 is disposed also upstream of the energy generating element 5 in the circulating direction. In the case where the position of bubble collapsing occurrence reaches the position of the electronic element 12 upstream of the energy generating element 5 in the circulating direction, the third anti-cavitation film 14 may further be extended.

<Modification>

Figure 7A:
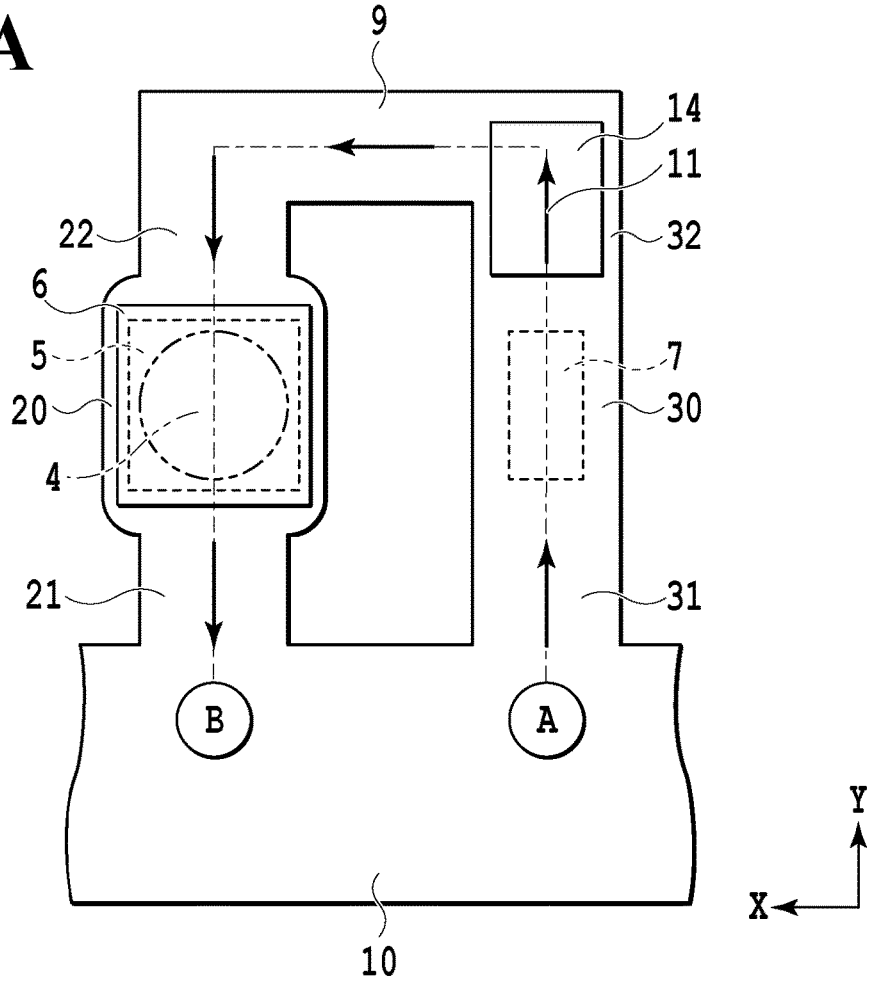
FIGS. 7A and 7B are a top view and cross-sectional view of part of an element substrate.
Figure 7B:
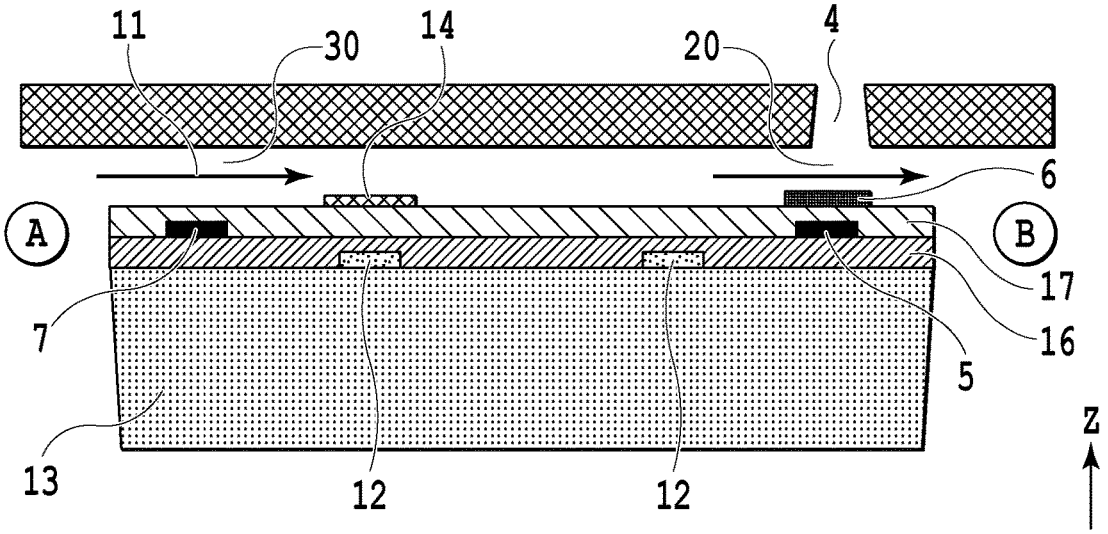

FIGS. 7A and 7B are diagrams illustrating a modification of this embodiment. FIG. 7A is a top view of part of an element substrate 2. FIG. 7B is a cross-sectional view of the element substrate taken along the circulating flow path from point A to point B, indicated with the dashed dotted lines in FIG. 7A. This modification is different from FIGS. 6A and 6B in that the second anti-cavitation film 8 in FIGS. 6A and 6B is not included. In the case where the bubble does not collapse in the area of the for-pumping heat generating element 7, the second anti-cavitation film 8 is not necessary as described in the second embodiment. In the case where in the variation in the position of the bubble collapsing occurrence, statistics show that bubble collapsing occurs in the area of the electronic element 12 frequently, the third anti-cavitation film 14 may be provided as has been described in this embodiment.

Fifth Embodiment

The configuration in this embodiment includes a first anti-cavitation film 6 for protecting the energy generating element 5 and a second anti-cavitation film 8 for protecting the for-pumping heat generating element 7 as in the first embodiment. In the configuration of this embodiment, the first anti-cavitation film 6 extends into the connection flow path 9.

Figure 8A:
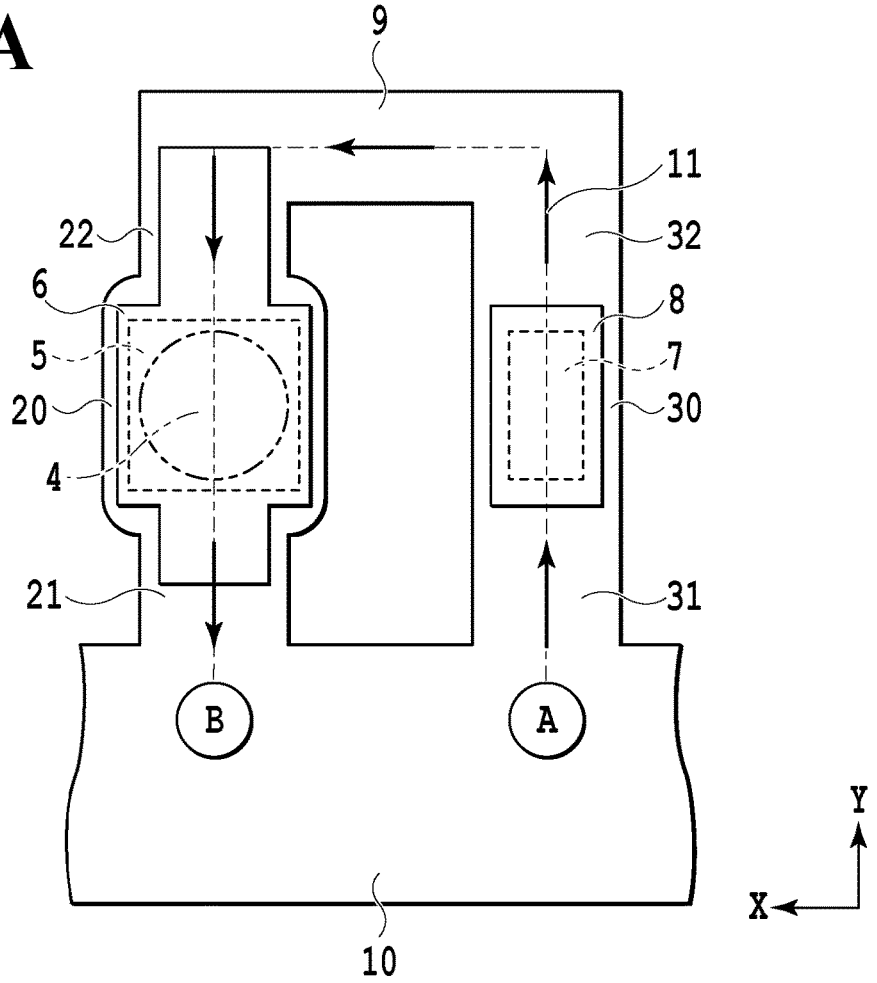
FIGS. 8A and 8B are a top view and cross-sectional view of part of an element substrate.
Figure 8B:
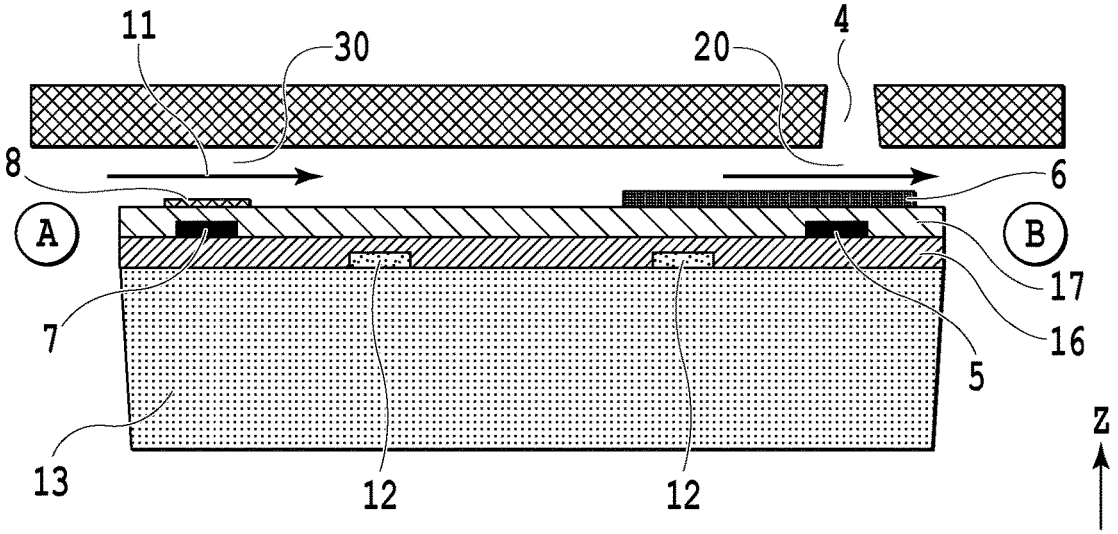

FIGS. 8A and 8B are diagrams illustrating part of an element substrate 2 of this embodiment. FIG. 8A is a top view of part of the element substrate 2. FIG. 8B is a cross-sectional view of the element substrate taken along the circulating flow path from point A to point B, indicated with the dashed dotted lines in FIG. 8A.

The reason why the first anti-cavitation film 6 extends into the connection flow path 9 in this embodiment is as follows. When the energy generating element 5 generates a bubble, there is a possibility that liquid may flow in the direction opposite to the arrows 11 due to the balance of the liquid resistance at the time of bubble collapsing, depending on the bubble generation timing of the for-pumping heat generating element 7 and the design of the liquid chamber of the pressure chamber 20. In that case, the first anti-cavitation film 6 extended into the connection flow path protects the electronic element 12 (on the pressure chamber side) for the same reason as in the third embodiment.

Note that when the liquid flow indicated by the arrows 11 is superior, there is a possibility that a bubble generated by the energy generating element 5 may move downstream in the circulating direction and then collapse, due to the bubble generation timing of the for-pumping heat generating element 7 and other factors. In other words, there is a possibility that the bubble may move from the energy generating element 5 toward the common liquid chamber 10 and then collapse. To address this, the first anti-cavitation film 6 may be extended, as illustrated in FIGS. 8A and 8B, toward the direction (toward the first end portion 21) opposite to the direction toward the connection flow path 9 in the flow path, when viewed from the energy generating element 5.

<Modification>

Although FIGS. 8A and 8B illustrate an example in which the first anti-cavitation film 6 extends in the directions toward both the first end portion 21 and the second end portion 22, the present disclosure is not limited to this example. An anti-cavitation film may be disposed over the electronic element (on the pressure chamber side), separately from the first anti-cavitation film 6.

Other Embodiments

Any embodiments and modifications described above may be combined into an embodiment to employ. For example, in the above description, the configurations in the second to fourth embodiments concern the arrangement of the second anti-cavitation film 8 and the configuration in the fifth embodiment concerns the arrangement of the first anti-cavitation film 6. The fifth embodiment may be combined with any one of the second to fourth embodiments. Specifically, the second anti-cavitation film 8 may be eliminated from the configuration illustrated in FIGS. 8A and 8B. In the configuration illustrated in FIGS. 8A and 8B, the second anti-cavitation film 8 may extend into the connection flow path 9. In the configuration illustrated in FIGS. 8A and 8B, in addition to the first anti-cavitation film 6 and the second anti-cavitation film, a third anti-cavitation film may be provided for protecting the electronic element 12 located downstream of the for-pumping heat generating element 7 in the circulating direction.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

The present disclosure improves the thermal efficiency and also improves the reliability of the anti-cavitation film, with the characteristics required for each element taken into account.

This application claims the benefit of Japanese Patent Application No. 2018-129083, filed Jul. 6, 2018, which is hereby incorporated by reference herein in its entirety.

What is claimed is:

1. A liquid ejecting head comprising an element substrate including:

a common liquid chamber connected to a liquid supply source;

a pressure chamber connected to the common liquid chamber and including inside an energy generating element to generate energy used for ejecting liquid;

a bubble generating chamber connected to the common liquid chamber and including inside a pump element to cause a flow of the liquid; and a connection flow path connecting the pressure chamber and the bubble generating chamber, wherein the liquid ejecting head includes a first anti-cavitation film over the energy generating element and a second anti-cavitation film over the pump element, and the first anti-cavitation film and the second anti-cavitation film have different film thicknesses.

2. The liquid ejecting head according to claim 1, wherein the film thickness of the first anti-cavitation film is greater than the film thickness of the second anti-cavitation film.

3. The liquid ejecting head according to claim 1, wherein the film thickness of the first anti-cavitation film is less than the film thickness of the second anti-cavitation film.

4. The liquid ejecting head according to claim 1, wherein the second anti-cavitation film extends from the pump element toward the connection flow path.

5. The liquid ejecting head according to claim 1, wherein the element substrate further includes an electronic element at a position downstream of the pump element in a liquid flow direction, and the liquid ejecting head further includes a third anti-cavitation film over the electronic element.

6. The liquid ejecting head according to claim 1, wherein the first anti-cavitation film extends at least toward the connection flow path from the energy generating element.

7. The liquid ejecting head according to claim 1, wherein the first anti-cavitation film extends at least toward the common liquid chamber from the energy generating element.

8. The liquid ejecting head according to claim 1, wherein the first anti-cavitation film and the second anti-cavitation film are metal films made of tantalum or iridium.

9. The liquid ejecting head according to claim 1, wherein the first anti-cavitation film and the second anti-cavitation film are different kinds of films.

10. The liquid ejecting head according to claim 9, wherein the different kinds of films include a single layer film and a layered film.

11. The liquid ejecting head according to claim 1, wherein the liquid in the pressure chamber circulates between the pressure chamber and outside of the pressure chamber.

12. The liquid ejecting head according to claim 1, wherein the pump element causes a flow of the liquid passing through the common liquid chamber, the bubble generating chamber, the connection flow path, and the pressure chamber in the listed order.

13. The liquid ejecting head according to claim 1, wherein the pressure chamber has a first end portion connected to the common liquid chamber and a second end portion connected to the connection flow path, and the bubble generating chamber has a first end portion connected to the common liquid chamber and a second end portion connected to the connection flow path.

14. The liquid ejecting head according to claim 1, wherein the pump element comprises a heating resistor element.

15. A liquid ejecting head comprising:

a common liquid chamber connected to a liquid supply source;

a pressure chamber connected to the common liquid chamber and including inside an energy generating element to generate energy used for ejecting liquid;

a bubble generating chamber connected to the common liquid chamber and including inside a pump element to cause a flow of the liquid; and a connection flow path connecting the pressure chamber and the bubble generating chamber, wherein the liquid ejecting head includes a first anti-cavitation film over the energy generating element and a second anti-cavitation film at a position downstream of the pump element in a liquid flow direction, the second anti-cavitation film not being provided over the pump element.

16. The liquid ejecting head according to claim 15, wherein the liquid in the pressure chamber circulates between the pressure chamber and outside of the pressure chamber.

17. The liquid ejecting head according to claim 15, wherein the pump element causes a flow of the liquid passing through the common liquid chamber, the bubble generating chamber, the connection flow path, and the pressure chamber in the listed order.

18. The liquid ejecting head according to claim 15, wherein the pressure chamber has a first end portion connected to the common liquid chamber and a second end portion connected to the connection flow path, and the bubble generating chamber has a first end portion connected to the common liquid chamber and a second end portion connected to the connection flow path.

19. The liquid ejecting head according to claim 15, wherein the pump element is a heating resistor element.

20. The liquid ejecting head according to claim 15, wherein the first anti-cavitation film extends at least toward the connection flow path from the energy generating element to generate the energy.

* * * * *